United States Patent [19]

Yamaguchi et al.

[11] 4,049,214

[45] Sept. 20, 1977

[54] METHOD AND APPARATUS FOR DRIVING REWINDING SHAFTS FOR SLIT STRIPS

[75] Inventors: Toshiaki Yamaguchi; Jinichi Shoji, both of Kyoto, Japan

[73] Assignee: Nishimura Seisakusho Co., Ltd., Kyoto, Japan

[21] Appl. No.: 706,782

[22] Filed: July 19, 1976

[30] Foreign Application Priority Data

July 21, 1975 Japan ..... 50-89953

[51] Int. Cl.[2] ..... B65H 59/00

[52] U.S. Cl. ..... 242/75.51; 242/75.53

[58] Field of Search ..... 242/75.51, 75.53, 75.5, 242/67.1 R, 67.3, 56.2, 56.4; 318/6, 7, 8

[56] References Cited

U.S. PATENT DOCUMENTS

| | | | |
|---|---|---|---|
| 1,720,118 | 7/1929 | Covey | 242/75.51 |
| 2,764,365 | 9/1956 | Davis | 242/75.53 |
| 3,603,521 | 9/1971 | Ormsby | 242/56.2 |

*Primary Examiner*—Edward J. McCarthy
*Attorney, Agent, or Firm*—Amster & Rothstein

[57] ABSTRACT

A method and apparatus for driving a plurality of strip rewinding shafts or cores are provided. The apparatus includes a plurality of hydraulic motors for separately driving a plurality of strip rewinding shafts or cores. The hydraulic motors are connected parallel with a common hydraulic pump to be independently and simultaneously driven by the pump. The hydraulic pump is in turn connected to a DC electric motor, the operation of which is controlled by a torque control to provide an output rotation of a desired torque characteristic. Also connected to the input of the torque control are means for setting the rotational speed of the DC motor, means for detecting the diameter of at least one strip roll being wound and means for detecting the output rotation of the DC motor. In response to output signals from these means, the torque control functions to control the operation of the DC motor for providing the output rotation of a desired torque characteristic which controllably drives the rewinding shaft simultaneously and independently through the hydraulic pump and its associated hydraulic motors.

4 Claims, 1 Drawing Figure

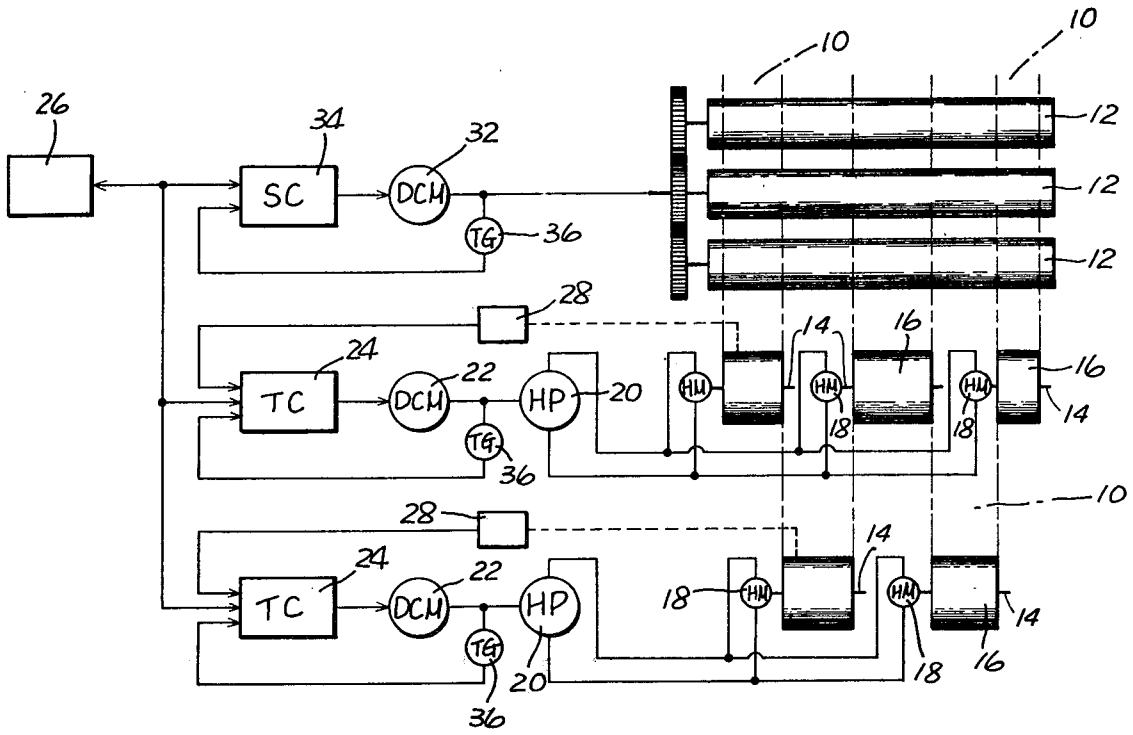
10
12
12
12
16
14
10
14
16
18
HM
16
18
14
HM
18
14
HM
18
HM
20
HP
28
36
TG
32
DCM
22
DCM
28
HP
20
36
TG
22
DCM
36
TG
34
SC
24
TC
24
TC
26

METHOD AND APPARATUS FOR DRIVING REWINDING SHAFTS FOR SLIT STRIPS

BACKGROUND OF THE INVENTION

This invention relates to a system for driving a plurality of slit strip rewinding shafts or cores. In particular, this invention relates to a method and apparatus for driving a plurality of independently driven rewind shafts or cores for simultaneously rewinding a plurality of slit strips.

In a web slitting machine, a flexible web material is slit into a plurality of narrower continuous strips of a uniform or different widths in a slitting section. These slit strips are simultaneously rewound into a plurality of rolls. The slit web strips are seemingly uniform in thickness but actually and precisely they are not uniform in thickness. Firstly, the thickness differs from strip to strip and, secondly, the thickness of each strip varies along its entire length. Although the difference or variation of the web thickness is rather small, it causes a corresponding difference in the diameter of strip rolls being wound on the rewind shaft. In winding simultaneously a plurality of slit strips, any difference in diameter among strip rolls being wound must be accommodated in order to rewind slit strips into rolls of a substantially uniform density or hardness. One prior and typical approach to accommodate a difference of roll diameter is to provide a separate rewind shaft for each strip roll to be wound and to have an independent driving source for each rewind shaft. The independent drive approach is generally satisfactory and acceptable when simultaneously rewinding a plurality of slit strips of a uniform width since it is not difficult and expensive to control the independent driving sources for the rewind shafts. However, when simultaneously rewinding a plurality of slit strips of different widths, it is necessary to separately control the independent driving sources for the rewind shafts, which involves an extremely complicated and expensive control system and procedure.

SUMMARY OF THE INVENTION

Accordingly, it is an object of the invention to provide an improved method and apparatus for driving a plurality of strip rewinding shafts which is simple in structure and inexpensive in cost.

It is a further object of the invention to provide an improved method and apparatus for simultaneously and independently driving a plurality of strip rewinding shafts or cores in such a manner as to accommodate any difference in the roll diameter of the strip rolls being wound on the rewind shafts or cores.

It is another object of the invention to provide an improved system for driving simultaneously and independently a plurality of strip rewinding shafts or cores in such a manner as to rewind a plurality of continuous slit strips of different widths onto the rewind shafts to form rolls of a substantially uniform density or hardness.

It is still another object of the invention to provide an improved hydraulic system for driving simultaneously and independently a plurality of strip rewinding shafts or cores in such a manner as to roll up a plurality of slit strips onto the rewinding shafts or core into rolls of a substantially uniform density or hardness.

Briefly stated, according to the invention, there is provided an apparatus for simultaneously and independently driving a plurality of strip rewinding shafts or cores. The apparatus includes a plurality of hydraulic motors connected respectively to the rewinding shafts for independently driving the shafts. All the hydraulic motors are connected parallel with a single and common hydraulic pump to be driven thereby. The hydraulic pump is in turn operably connected to a drive source, the output force of which is under the control of a torque control means. Speed setting means is connected to the input of the torque control to supply a speed setting signal. Also connected to the output of the torque control are means for detecting the diameter of at least one strip roll being wound on a rewind shaft and means for detecting the output rotation of the drive source, respectively providing a signal indicating the roll diameter and a signal indicating the output rotation of the drive source to the torque control.

With the apparatus of the invention and according to a method for driving a plurality of strip rewinding shaft of the invention, the drive source drives the hydraulic pump which in turn rotates the parallel connected hydraulic motors fcr the rewind shafts simultaneously but separately. The torque control, being supplied with signals indicating the diameter of the strip roll being wound and the output rotation of the drive source, controls the output torque of the drive source such that the drive source may rotate via the hydraulic pump the plurality of hydraulic motors to simultaneously rewind the slit strips with a desired varying tension through a rewinding cycle. Since each rewind shaft is driven by a separate hydraulic motor and every hydraulic motor is connected parallel to a common hydraulic pump, rewind shafts are rotated in a differential way to accommodate any difference of rotation among strip rolls being wound on the rewind shaft due to a difference of the roll diameter, which in turn may be caused by irregular thickness of slit strips.

BRIEF DESCRIPTION OF THE DRAWINGS

A single FIGURE in the attached drawing is a schematic illustration of an apparatus embodying the invention.

DETAILED DESCRIPTION OF THE PREFERRED EMBODIMENT

Referring now to the drawing, there is illustrated a system for controllably driving a plurality of strip rewinding cores according to a preferred embodiment of the invention. In a typical web slitting machine, a continuous and flexible web material is slit into a plurality of narrower strips 10 in a slitting section and these slit strips are led through feed rollers 12 onto respective rewinding shafts 14 to be wound into rolls 16. In the illustrated example, a plurality of rewinding shafts are arranged into two parallel rows in an alternating fashion and each shaft is adapted to be independently driven by a separate hydraulic motor 18 of variable capacity. Hydraulic motors 18 for driving rewinding cores in each row are operably connected in parallel with a common hydraulic pump 20 to form a hydraulic drive circuit. Where the rewinding shafts 14 are arranged in two separate rows as illustrated in the drawing, two hydraulic pumps are provided, one for each row of shafts. The hydraulic pumps 20 are connected to be driven by their respective DC electric motors 22, the output rotation of which is separately controlled by associated torque controls 24 to provide a desired torque characteristic as explained in detail below. According to the invention, several control signals are fed into each of the torque controls 24. Firstly, a speed setting device 26 is connected to the torque controls to supply a speed setting signal to their inputs. Secondly, a device 28 for detecting the diameter of at least one strip roll being wound on a rewind shaft in each row is operably connected to respective torque control 24 to supply a control signal. Thirdly, a tachometer generator 36 is connected to the output shaft of each DC electric motor 22 to produce and feed back a signal indicating the output rotation of the motor to the associated torque control 24. If desired, other signals than those mentioned above may be fed into the torque controls to obtain the desired control results.

In order to positively rotate the strip feed rollers 12, there is also provided a DC electric motor 32 in driving connection with the feed rollers. The drive motor 32 is under the control of a speed controller 34 which receives a control signal from the speed setting device 26. A tachometer generator 36 is also connected to the shaft of the drive motor 32 to produce and feed back a signal indicating the output rotation of the motor to the speed controller 34.

With the illustrated system, the hydraulic pumps 20 are driven by their respective electric motors 22 with a rotating force of a controlled torque characteristic to rotate the associated rewinding shafts 14 such that the tension under which the slit strips are wound may be varied as desired according to the increasing diameter of wound strip rolls 16.

In rewinding a continuous web strip onto a shaft, the rewinding tension under which the strip is rewound into a roll decreases in an inverse proportion according as the diameter of the wound roll increases if the rewind shaft is rotated at a constant driving torque throughout a rewinding cycle. However, in order to obtain a wound roll of a desired density throughout its thickness and to prevent the strip from being broken apart under the increasing tension, it is proposed to gradually and slightly reduce the rewinding tension as the roll diameter is increased. In other words, the strip is preferably wound under a slightly decreasing tension (which is commonly called a "tapered tension" in the industry). One approach to obtain the desired tapered rewinding tension is to gradually increase the driving torque for the rewind shaft in accordance with the increasing roll diameter. Therefore, the phrase "the driving force of a desired torque characteristic" here is used to mean a force that can rotate the rewind shaft with an increasing driving torque so that the strip may be wound up with the desired tapered tension through the rewinding cycle. Therefore, the function of the torque controls 24 is to control the operation of the DC electric motors 22 into providing such output rotation that can rotate the rewinding shaft 14 via the hydraulic circuit with a driving torque which increases according as the roll diameter is increased in order to obtain a desired rewinding tension characteristic. As the torque control, suitable known devices may be used. For example, a DC electric motor is suitable for the purpose in that its output rotation and torque are readily controlled by changing the energizing current and voltage supplied to the motor. The electromagnetic coupling and powder clutch wherein the torque transmission can be controlled by adjusting energizing current are also used to advantage. A pneumatic slip clutch may also be mentioned.

Since the operation and function of such torque control devices are well known to those skilled in the art, no detailed description is given here. However, in connection with the drive system of this invention, it is pointed out that a speed setting signal, roll diameter indicating signal and signal indicating the output rotation of the DC electric motor are supplied to the torque controls 24 as the input signal although only one or two of them are sufficient for the control purpose in some application. Additionally, a signal for setting the rewinding tension and a signal for obtaining a desired tapered tension characteristic may be supplied to the input of the torque controls if desired. In setting the rewinding tension, such parameters as tension per unit area of the wound strips, the thickness and total width of the slit strips being wound must be considered. Further, in order to compensate for any temporary change of the rewinding tension due to acceleration and deceleration of the rewinding speed, the volume of tension that must be compensated may arithemetically be obtained from signals indicating the roll diameter and strip widths supplied to the torque control for controlling the rewinding tension.

According to the invention, the torque controlled output forces of the DC electric motors 22 drive the hydraulic pumps 20 which in turn simultaneously drive their respective, parallel-connected hydraulic motors 18. Each hydraulic motor rotates a separate rewinding shaft 14 to independently wind up a continuous strip 10 into a roll 16. With the arrangement, while a plurality of slit strips are wound simultaneously and independently by their respectively driven rewinding shafts, this separate rewinding is essentially the same as a unitary rewinding where a plurality of strips are wound on a common rewinding core rotated by a common driving source as far as the rewinding tension throughout the rewinding cycle is concerned. And in this regard, the hydraulic circuit including one hydraulic pump and a plurality of parallel connected hydraulic motor is but a mere system for transmitting a driving force. However, as far as each of the rewinding shaft and its associated hydraulic motor in each row are concerned, the rewinding shafts are rotatable independent of each other and are driven in a differential way so that any difference of roll diameter among strip rolls being wound (which is rather small but inevitably occurs in actual rewinding process) is accommodated by a corresponding variation of rotation among the rewind shaft. As a result, all of the strip rolls are wound onto the shafts at a substantially uniform density or hardness.

As is apparent to those skilled in the art, a flexible web is not necessarily slit into a plurality of continuous strips of a uniform width in the web slitting machine. When a web material is slit into strips of different widths, it is necessary to apply different rewind tensions on different slips depending on the width of the strip. According to the invention, since all of the hydraulic motors 18 are of variably capacity type, it is possible to rewind slit strips of different widths under different rewind tensions by individually adjusting the capacity of hydraulic motors in proportion to the width of the slit strips.

In the illustrated system, the rewind shafts are arranged in two groups or rows, each group having its own hydraulic drive circuit with a separate hydraulic pump. This arrangement makes it possible to rewind strips into rolls of two different roll diameters, one for the first group of rewind shafts and the other for the second group of rewind shafts. On the other hand, if it is intended to rewind web strips onto the rewinding shafts into rolls of substantially the same diameter, then hydraulic motors for both groups of rewind shafts may be connected parallel with a single and common hydraulic pump.

It should also be pointed out that, unless the ratio between the capacity or volume of each hydraulic pump and the total capacity or volume of the hydraulic motors connected to the pump is predetermined constant, a desired transmission ratio is not attained in the hydraulic circuit, which will adversely affect the rewinding results. In order to avoid this problem, a hydraulic pump of variable volume may be employed for the hydraulic pumps in the circuits. With the variable volume hydraulic pumps, the volume ratio between the hydraulic pump and its associated hydraulic motors may readily be kept at a desired constant value by adjusting the volume of the hydraulic pump.

While there has been described only one most preferred embodiment of the invention, various other changes and modifications may be made by those skilled in the art within the spirit and scope of the invention.

What we claim is:

1. A method of rewinding a plurality of slit strips into rolls on separate rewind shafts comprising driving a first hydraulic pump connected to a first group of said shafts;

driving a second hydraulic pump connected to a second group of said shafts;

interconnecting a first plurality of variable volume hydraulic motors in parallel between said first hydraulic pump and said first group of shafts;

interconnecting a second plurality of variable volume hydraulic motors in parallel between said second hydraulic pump and said second group of shafts; and providing control means to control said hydraulic pumps to rotate said shafts separately with independent adjustment of the volume of each said hydraulic motor in relation to the width of the respective strip being rewound.

2. A method according to claim 1 wherein signals are directed to the control means comprising a first signal determined by preselected speed setting means;

a second signal determined by changing diameter of at least one roll; and a third signal determined by rotation speed of said hydraulic pumps.

3. Apparatus for driving a plurality of slit rewinding shafts for strip rolls comprising at least two groups of said shafts, each group having connected thereto a plurality of hydraulic motors corresponding in number to the number of shafts in said group, said hydraulic motors connected to respectively and differentially drive said shafts;

each group having further connected thereto a driving unit comprised of a torque control, an electric motor and a hydraulic pump, said hydraulic pump being driven by said electric motor whose output rotation is controlled by said torque control;

said hydraulic motors of each group being connected in parallel with said hydraulic pump of said respective group; and control means connected to each said torque control and comprising input speed setting means, roll diameter detection means and electric motor output detection means to provide independent variation of rotation of each of said rewind shafts.

4. Apparatus according to claim 3 wherein each of said electric motors is of the direct current type and each of the hydraulic pumps is of the variable volume type.

* * * * *